US012503870B2

(12) United States Patent
Abu-Aisheh et al.

(10) Patent No.: US 12,503,870 B2
(45) Date of Patent: Dec. 23, 2025

(54) RESTORING SEAWATER CANAL DIVIDER WALLS

(71) Applicant: Saudi Arabian Oil Company, Dhahran (SA)

(72) Inventors: Emad Abu-Aisheh, Hoppers Crossings (AU); Mahmoud A. Dweib, Arlington, WA (US); Khalid M. Alnabulsi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/471,964

(22) Filed: Sep. 21, 2023

(65) Prior Publication Data

US 2025/0101758 A1 Mar. 27, 2025

(51) Int. Cl.

| | |
|---|---|
| ***E04G 23/02*** | (2006.01) |
| ***E02B 5/02*** | (2006.01) |
| ***E02B 5/08*** | (2006.01) |

(52) U.S. Cl.
CPC ..... *E04G 23/0218* (2013.01); *E02B 5/02* (2013.01); *E02B 5/087* (2013.01)

(58) Field of Classification Search
CPC ..... E02B 3/06; E02B 5/02; E02B 5/087
See application file for complete search history.

(56) References Cited

U.S. PATENT DOCUMENTS

| | | | | |
|---|---|---|---|---|
| 4,674,921 | A * | 6/1987 | Berger | E02D 5/74 405/262 |
| 4,911,582 | A * | 3/1990 | Peirce, Jr. | E02D 29/0275 405/262 |
| 5,538,363 | A * | 7/1996 | Eastwood | E02D 29/0233 405/262 |
| 6,434,900 | B1 * | 8/2002 | Masters | E01F 8/0023 256/73 |
| 7,059,807 | B2 * | 6/2006 | Irvine | E02B 3/066 405/262 |
| 7,416,368 | B2 | 8/2008 | Dagher et al. | |
| 7,736,096 | B1 * | 6/2010 | Aaron | E02D 29/02 405/286 |
| 10,870,964 | B2 | 12/2020 | Krasnoff | |
| 2009/0188180 | A1 | 7/2009 | Irvine et al. | |
| 2016/0010297 | A1 * | 1/2016 | Tavella | E02B 3/066 405/287 |
| 2018/0266065 | A1 | 9/2018 | Leichti et al. | |
| 2022/0411568 | A1 | 12/2022 | Yang et al. | |
| 2023/0018655 | A1 | 1/2023 | Bruchertseifer et al. | |
| 2023/0027874 | A1 * | 1/2023 | Fulcher | E02D 29/02 |

OTHER PUBLICATIONS

International Titanium Association, "Why are marine engineers turning to titanium for corrosion resistance"; All; 1999 (Year: 1999).*

(Continued)

*Primary Examiner* — Benjamin F Fiorello
(74) *Attorney, Agent, or Firm* — Fish & Richardson P.C.

(57) ABSTRACT

An approach to restoring and protecting a canal divider wall includes positioning a precast panel over the wall in the channel with an inner cavity of the precast panel; installing a titanium bolt through the precast panel and the wall in the channel; and pumping a polymer grout through a bore defined in the cap.

14 Claims, 4 Drawing Sheets

(56) References Cited

OTHER PUBLICATIONS

Titanium Industries, Inc. "Titanium Seawater Application"; All' 2021 (Year: 2021).*
Ashpiz et al., "Application of composite materials for the protection of sea shores and engineering structures against the impact of waves," WIT Transactions on Ecology and the Environment, 2010, 130:231-238, 8 pages.

* cited by examiner

RESTORING SEAWATER CANAL DIVIDER WALLS

TECHNICAL FIELD

This specification relates to repairing concrete walls, particularly concrete walls exposed to saltwater.

BACKGROUND

Refineries that use a large amount of steam and cooling water need to have an abundant source of water. This is one reason that oil refineries are often located near the sea. In some cases, the volume of needed water is sufficient that canals are used to transport water between the sea and a refinery.

SUMMARY

This specification describes an approach to restoring and protecting canal divider walls, particularly concrete divider walls in canals carrying saltwater. For example, seawater is often used in refineries and petrochemical plants for cooling and other purposes. These plants often have one or more canals extending to an adjacent source of cooling water. Typically, a cooling water canal includes a concrete wall used to separate the canal into an intake channel and a return channel. This wall is subject to aggressive seawater and hydrocarbon environments that result in concrete deterioration and severe steel reinforcement corrosion that can occur in a relatively short time.

This approach to restoration of existing deteriorated and corroded divider wall is based on precast structural concrete panels. The panels are made from high-performance highly durable polymer concrete with glass fiber reinforced polymer rebars. The panels can be coated (e.g., with a 1-2 mm polyurethane or polyurea elastomer) to resist UV and to better resist seawater. This approach limits water ingress into polymer concrete as polymer concrete is impermeable and the system is able to resist UV degradation.

The panels are sized to fit over the existing divider walls that are being repaired. In use, the panels are placed over an existing divider wall and bolts (e.g., titanium bolts) are used to anchor the panels to the existing divider wall. Flowable polymer grout is then injected between panels and the existing divider wall.

The approach disclosed in this specification can be used to repair canal divider walls while the canal is in service. This feature enables the restoration of canal divider walls without requiring the lengthy shutdown required when a canal is taken out of service for demolition and restoration of the divider wall. In contrast, an earlier approach to extending the useful service life of a canal system is to demolish the deteriorated wall and construct a new divider wall with an appropriate waterproofing membrane. This earlier approach requires lowering the water level in the canal to eliminate the need for divers and to allow construction to proceed using conventional methods. It also requires application of waterproofing membrane which needs to be maintained and reapplied in later stages. Lowering of water level to an acceptable level for this approach requires a complete shutdown for months of construction resulting in considerable loss of production and high construction cost.

The approach disclosed in this specification is comprehensive, durable, sustainable and more efficient than conventional applied methods. In addition, this solution will be a permanent solution for this issue. This approach is faster to install and lower cost compared to rebuilding a new wall.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

This specification describes an approach to restoring and protecting canal divider walls, particularly concrete divider walls in canals carrying saltwater. For example, some refineries have one or more canals extending to an adjacent source of cooling water. Typically, a cooling water canal includes a concrete wall used to separate the canal into an intake channel and a return channel. This wall is subject to aggressive seawater and hydrocarbon environments that result in concrete deterioration and severe steel reinforcement corrosion that can occur in a relatively short time.

This approach to restoration of existing deteriorated and corroded divider wall is based on precast structural concrete panels. The panels are made from high-performance highly durable polymer concrete with glass fiber reinforced polymer rebars. The panels can be coated (e.g., with a 1-2 mm polyurethane or polyurea elastomer) to resist UV and to better resist seawater. This approach limits water ingress into polymer concrete as polymer concrete is impermeable and the system is able to resist UV degradation.

The panels are sized to fit over the existing divider walls that are being repaired. In use, the panels are placed over an existing divider wall and bolts (e.g., titanium bolts) are used to anchor the panels to the existing divider wall. Flowable polymer grout is then injected between panels and the existing divider wall.

Figure 1A:
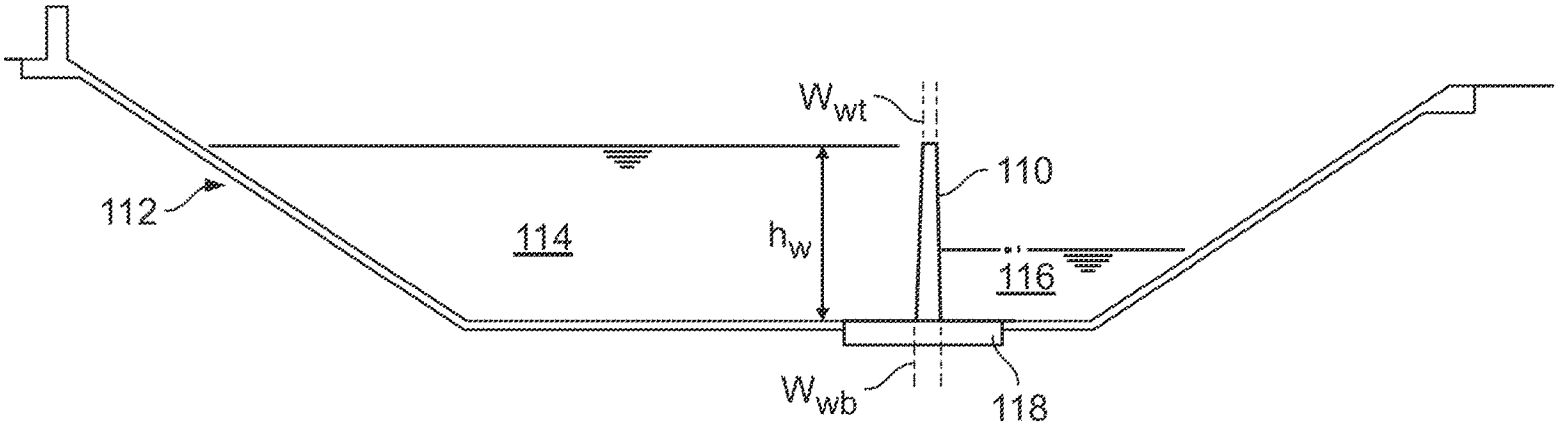
FIG. 1A and FIG. 1B are schematic views of a canal divider wall without and with, respectively, repair panels installed.
Figure 1B:
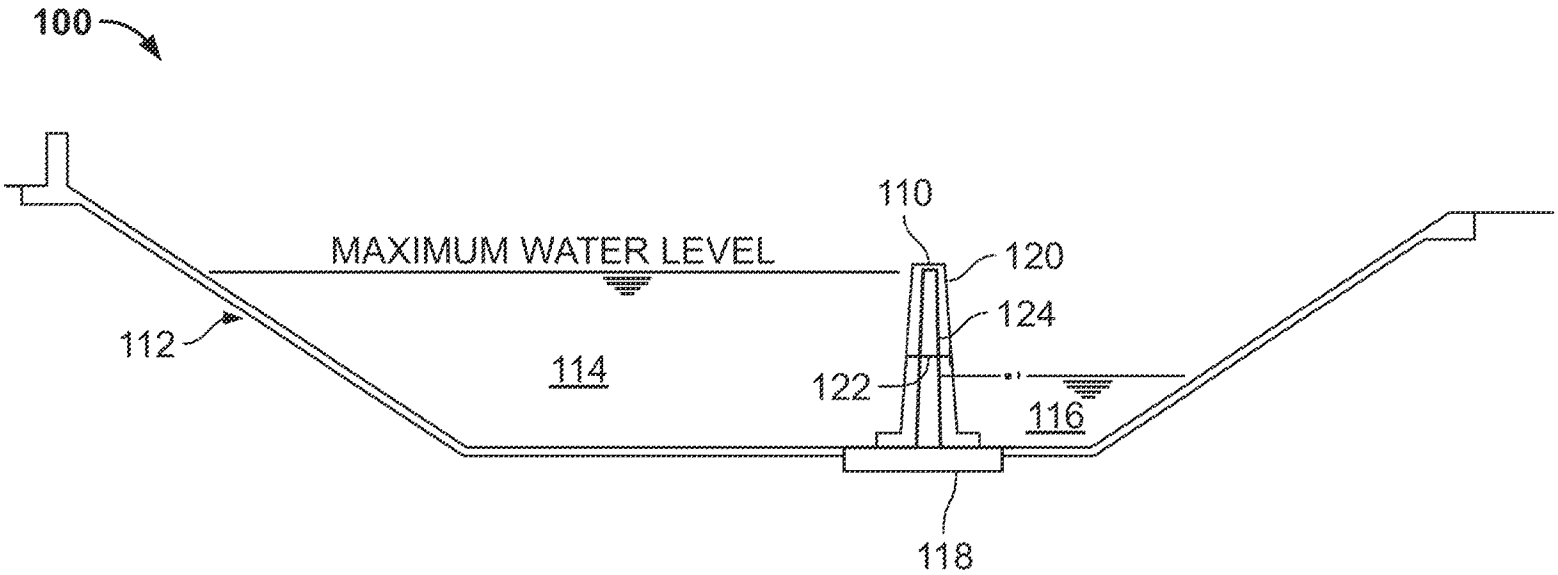

FIG. 1A and FIG. 1B illustrate a system 100 for restoring and protecting a divider wall 110 in a canal 112. FIG. 1A illustrates the divider wall 110 before repairs. FIG. 1B illustrates the system 100 installed over and attached to the divider wall 110 after repairs. The divider wall 110 separates the canal 112 into an intake channel 114 and a return channel 116. The divider wall 110 extends upward from footers 118 in the bottom of the canal 112. The divider wall has a height $h_w$ and tapers from top width $W_{wt}$ to a wider bottom width $W_{wb}$. Divider walls typically have heights $h_w$ between 1.5 and 3 m, top widths $W_{wt}$ between 0.2 m and 0.5 m and bottom widths $W_{wb}$ between 0.35 m and 0.6 m.

The system 100 includes precast panels 120 which are attached to the divider wall 110 and the footers 118. In this implementation, the precast panels 120 are attached to the divider wall 110 and the footers 118 using bolts (e.g., titanium bolts 122). A polymer grout 124 is injected between the divider wall 110 and the precast panels 120.

Figure 2A:
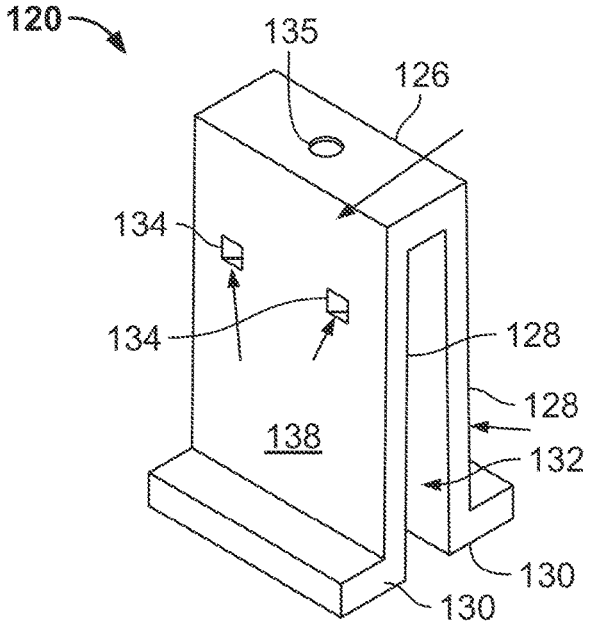
FIG. 2A and FIG. 2B are, respectively, a perspective view and a cross-sectional view of an individual repair panel.
Figure 2B:
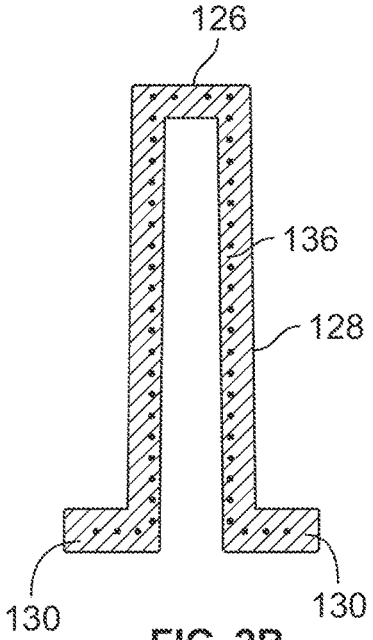

FIG. 2A and FIG. 2B are, respectively, a perspective view and a cross-sectional view of an individual panel 120. The panel 120 has walls defining an inner cavity large enough to receive a divider wall 110 being repaired. For example, the panel 120 includes a cap 126, two side walls 128, and two flanges 130.

The two side walls 128 are attached to and extend from the cap 126 to define an inner cavity 132 sized to receive a segment of the divider wall 110. It is desirable that the inner cavity be large enough to easily fit over the divider wall with an inner surface generally conforming to the outer surface of the wall 110. The inner cavity 132 has an open edge opposite the cap 126 and open ends. The two side walls 128 extend away from the cap 126 at an angle such that the open edge of the inner cavity is wider than an inner surface of the cap.

The side walls 128 define bores 134 configured to receive the bolts 122 used to attach the panel 120 to the wall 110 being repaired. The bores 134 in the side walls 128 are typically 0.02-0.040 m with the bores 134 in each side wall 128 are aligned with corresponding bores 134 in the other side wall 128. Although the side walls 128 each have two bores, some panels 120 have side walls 128 with more than two bores.

Each flange 130 is attached to one of the side walls 128 and extend outward from the side wall 128 away from the inner cavity 132. The flanges 130 have flat bottom surfaces that, in use, support the panel on the floor of the canal. In some implementations, the flanges 130 define bores configured to receive bolts used to attach the panel 120 to the footers 118 of the wall 110 being repaired.

The cap 126 also defines a bore 135 extending through the cap 126 to the inner cavity 132. The bore 135 is 50 mm in diameter and designed for injecting grout. During installation, grout is pumped into the space between the panel 120 and wall 110 through the bore 134 extending through the cap 126.

The panel is precast of polymer concrete mix. Preferred properties of the concrete include compressive strength of 60 MPa or more; slump>140 mm; permeability<1000 coulombs in accordance with ASTM C1240; and absorption equal to or less than 1% in accordance with BS 1881 part 122. A polymer concrete typical mix can be made of noncalcarious basalt aggregates (730-760 kg/m$^3$), sand (700-720 kg/m$^3$), natural pozzolan cementitious material (110-130 kg/m$^3$), and orthophythalic polyester resin (140-160 kg/m$^2$). Alternatively, a commercially available, ready mix, polymer concrete can be used for this purpose (SIKA, BASF, FOSROC, etc.).

The cap 126, the side walls 128, and the flanges 130 are include glass fiber reinforced polymer rebars 136 disposed in the polymer concrete matrix. The glass fiber reinforced polymer rebars are typically made of long glass fiber strands and thermosetting resin, such as vinyl ester or epoxy. An elastomer coating 138 is applied to the outer surfaces of the panels 120

Figure 3:
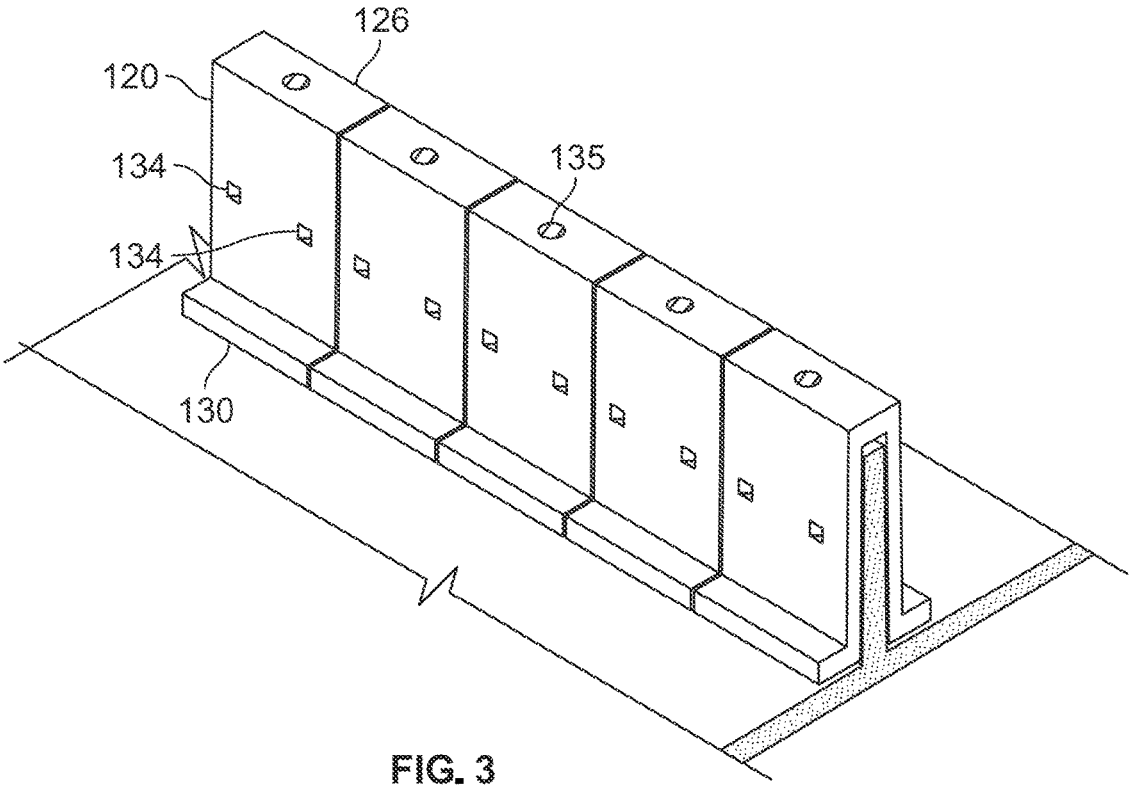
FIG. 3 is a perspective view of five repair panels installed on a divider wall.
Figure 4:
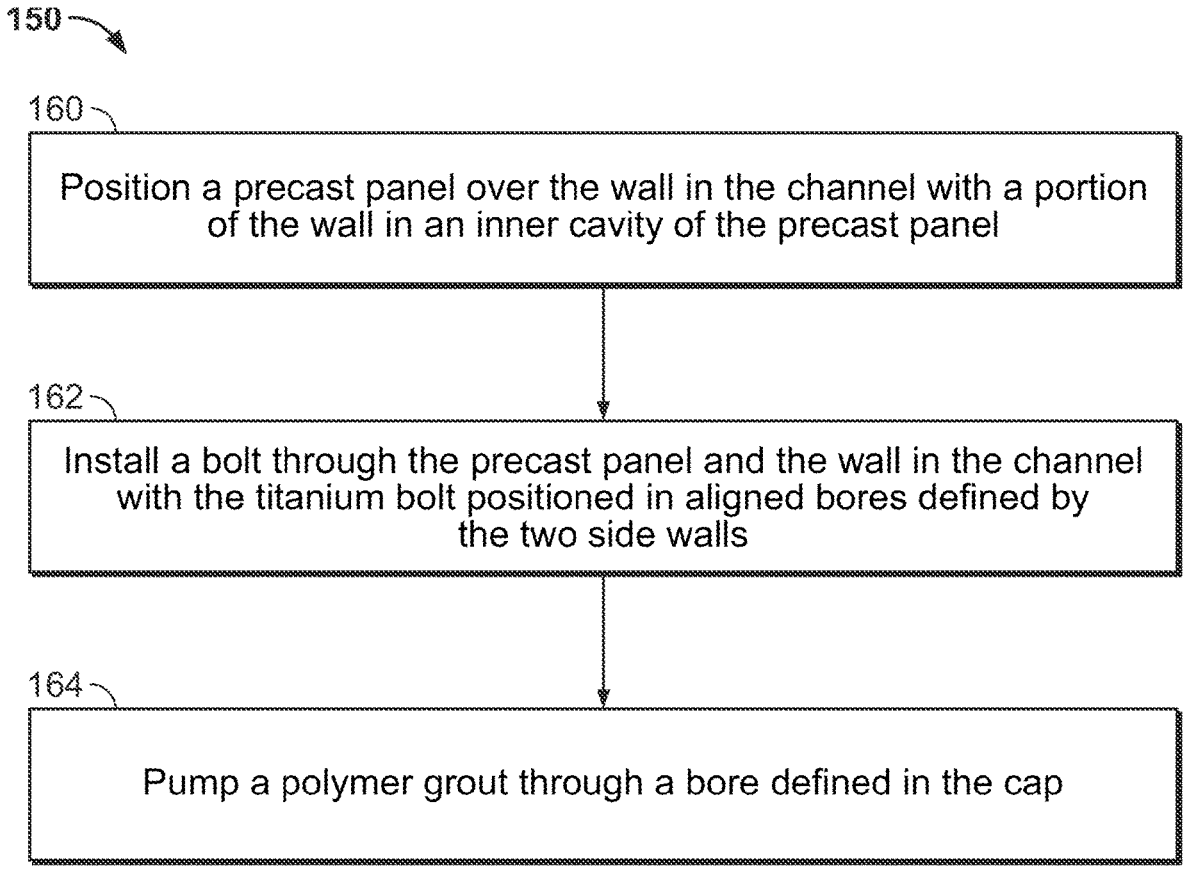
FIG. 4 is a flow chart of a method for restoring canal divider walls.

FIG. 3 is a perspective view of five panels 120 of the system 100 installed on a divider wall 110. FIG. 4 is a flow chart of a method 150 installing the panels 120. The method 150 is described with respect to components of the system 100 described with reference to FIGS. 1A-3.

One of the precast panels 120 is positioned over the wall 110 in the channel with a portion of the wall 110 in an inner cavity of the precast panel (step 160). As described with reference to FIGS. 1A, 1B, 2A, and 2B, the inner cavity 132 is defined by the cap 126 and two side walls 128 attached to and extending from the cap 126. Bolt(s) (e.g., two titanium bolts) is (are) installed through the precast panel 120 and the wall 110 in the channel with the bolt(s) positioned in aligned bores 134 defined by the two side walls 128 (step 162). The polymer grout is pumped through a bore 134 defined in the cap 126 (step 164). Typically, multiple panels are installed with each panels positioned abutting at least one adjacent precast panel.

Positioning the plurality of precast panels over the wall in the channel can be performed while water is present in the channel. In some cases, the precast panel includes two flanges, each flange attached to one of the side walls and extending outward from the side wall away from the inner cavity. In these cases, positioning the precast panel over the wall can include positioning the precast panel over the wall with the two flanges resting on a bottom of the channel.

When installing multiple panels, multiple caps or panels are assembled/installed, and bolted in place before grout is injected in the gap through the bores.

Figure 5:
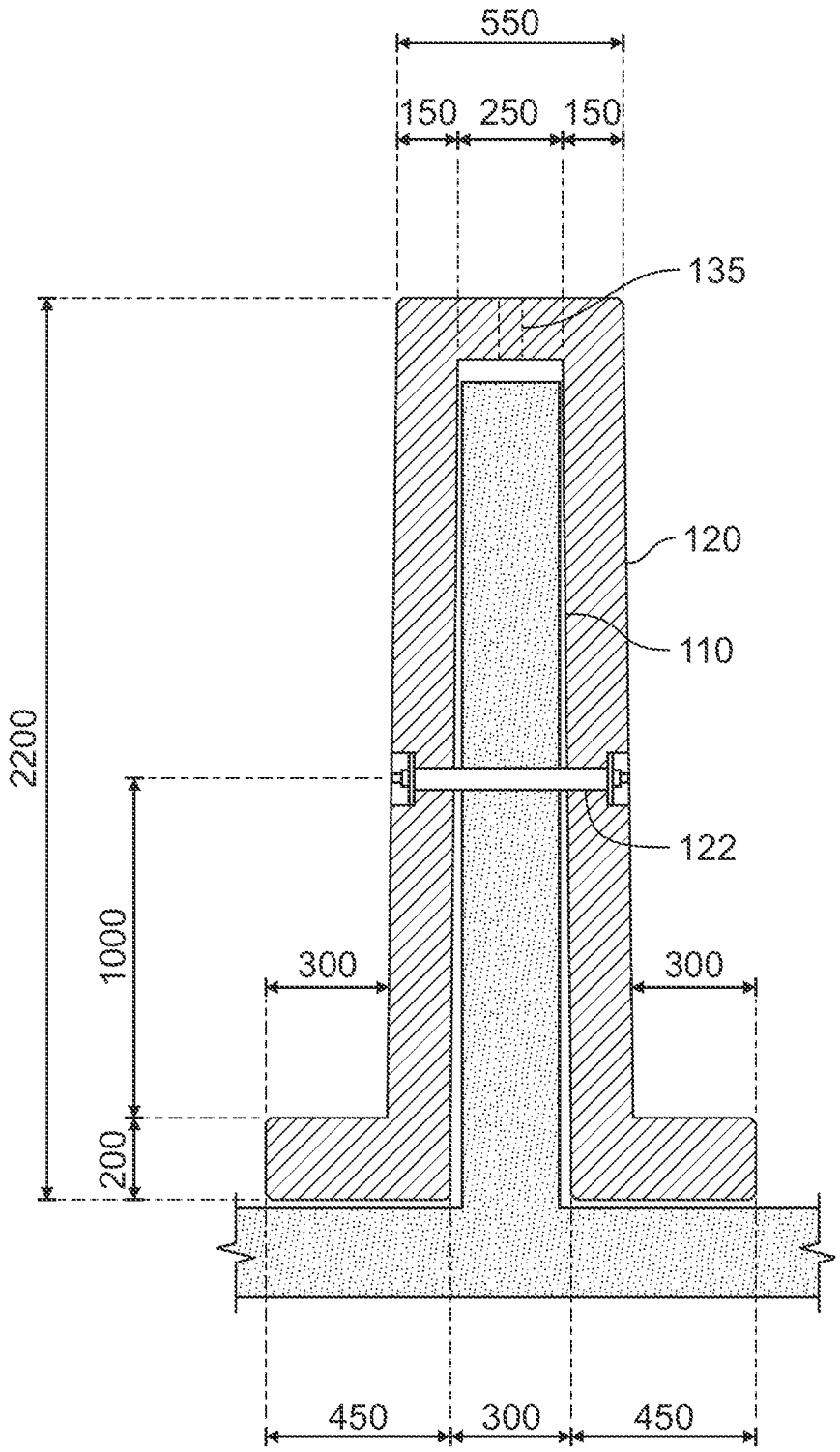
FIG. 5 is a cross-sectional view of a repair panel installed over a divider wall with the rebar omitted for clarity of illustration.

FIG. 5 is a cross-sectional view of a repair panel installed over a divider wall with the rebar omitted for clarity of illustration. This view includes dimensions in millimeters of a prototype being tested.

EXAMPLES

In some implementations, systems for restoring and protecting a canal divider wall includes: titanium bolts; polymer grout; and a plurality of precast panels. Each of the precast panels includes: a cap defining at least one bore extending through the cap; two side walls attached to and extending from the cap to define an inner cavity sized to receive a segment of the canal divider wall, each of the two side walls defining at least one bore extending through the side walls; and two flanges, each flange attached to one of the side walls and extending outward from the side wall away from the inner cavity. The inner cavity has an open edge opposite the cap and open ends.

In an example implementation combinable with any other example implementation, the precast panels include glass fiber reinforced polymer rebars disposed in a polymer concrete matrix. In some cases, the system also includes an elastomer coating the body of each of the precast panels.

In an example implementation combinable with any other example implementation, the two side walls extend away from the cap at an angle such that the open edge of the inner cavity is wider than an inner surface of the cap.

In some implementations, methods for restoring and protecting a canal divider wall include: positioning a precast panel over the wall in the channel with an inner cavity of the precast panel, the inner cavity defined by a cap and two side walls attached to and extending from the cap; installing a titanium bolt through the precast panel and the wall in the channel with the titanium bolt positioned in aligned bores defined by the two side walls; and pumping a polymer grout through a bore defined in the cap.

In an example implementation combinable with any other example implementation, positioning the plurality of precast panels over the wall in the channel is performed while water is present in the channel.

In an example implementation combinable with any other example implementation, the precast panel includes two flanges, each flange attached to one of the side walls and extending outward from the side wall away from the inner cavity.

In an example implementation combinable with any other example implementation, positioning the precast panel over the wall comprises positioning the precast panel over the wall with the two flanges resting on a bottom of the channel.

In an example implementation combinable with any other example implementation, the precast panel is one of a plurality of precast panels and each of the plurality of precast panels is positioned abutting at least one adjacent precast panel.

A number of embodiments of the systems and methods have been described. Nevertheless, it will be understood that various modifications may be made without departing from the spirit and scope of this specification. Accordingly, other embodiments are within the scope of the following claims.

What is claimed is:

1. A system for restoring and protecting a canal divider wall, the system comprising:

titanium bolts;

polymer grout; and a plurality of precast panels, wherein each of the precast panels comprises:

a cap defining at least one bore extending through the cap;

two side walls attached to and extending from the cap to define an inner cavity sized to receive a segment of the canal divider wall, each of the two side walls defining at least one bore extending through the side walls; and two flanges, each flange attached to one of the side walls and extending outward from the side wall away from the inner cavity;

wherein the inner cavity has an open edge opposite the cap and open ends.

2. The system of claim 1, the precast panels include glass fiber reinforced polymer rebars disposed in a polymer concrete matrix.

3. The system of claim 2, further comprising an elastomer coating the body of each of the precast panels.

4. The system of claim 1, wherein the two side walls extend away from the cap at an angle such that the open edge of the inner cavity is wider than an inner surface of the cap.

5. A system for restoring and protecting a canal divider wall, the system comprising:

titanium bolts;

polymer grout; and a plurality of precast panels, wherein each of the precast panels comprises:

a cap;

two side walls attached to and extending from the cap to define an inner cavity sized to receive a segment of an existing segment of the canal divider wall; and two flanges, each flange attached to one of the side walls and extending outward from the side wall away from the inner cavity;

wherein the inner cavity has an open edge opposite the cap and open ends.

6. The system of claim 5, wherein the precast panels include glass fiber reinforced polymer rebars disposed in a polymer concrete matrix.

7. The system of claim 6, further comprising an elastomer coating the body of each of the precast panels.

8. The system of claim 7, wherein the two side walls extend away from the cap at an angle such that the open edge of the inner cavity is wider than an inner surface of the cap.

9. The system of claim 8, wherein the cap defines at least one bore extending through the cap.

10. The system of claim 9, wherein each of the two side walls defines at least one bore extending through the side walls.

11. A method for repairing a wall in a channel, the method comprising:

positioning a precast panel over the wall in the channel with an inner cavity of the precast panel, the inner cavity defined by a cap and two side walls attached to and extending from the cap;

installing a titanium bolt through the two side walls of the precast panel and the wall in the channel with the titanium bolt positioned in aligned bores defined by the two side walls; and pumping a polymer grout through a bore defined in the cap, wherein the precast panel comprises two flanges, each flange attached to one of the sidewalls and extending outward from the side wall away from the inner cavity, wherein positioning the precast panel over the wall comprises positioning the precast panel over the wall with the two flanges resting on a bottom of the channel.

12. The method of claim 11, wherein positioning the plurality of precast panels over the wall in the channel is performed while water is present in the channel.

13. The method of claim 11, wherein the precast panel is one of a plurality of precast panels and each of the plurality of precast panels is positioned abutting at least one adjacent precast panel.

14. A method for repairing a wall in a channel, the method comprising:

positioning a precast panel over the wall in the channel with an inner cavity of the precast panel, the inner cavity defined by a cap and two side walls attached to and extending from the cap, wherein the precast panel comprises two flanges, each flange attached to one of the side walls and extending outward from the side wall away from the inner cavity;

installing a titanium bolt through the precast panel and the wall in the channel with the titanium bolt positioned in aligned bores defined by the two side walls; and pumping a polymer grout through a bore defined in the cap.

* * * * *